United States Patent [19]

Langen et al.

[11] Patent Number: 4,759,167

[45] Date of Patent: Jul. 26, 1988

[54] PACKAGING MACHINE

[75] Inventors: Marinus J. M. Langen, Toronto; Peter Guttinger, Rexdale, both of Canada

[73] Assignee: H. J. Langen & Sons Limited, Mississauga, Canada

[21] Appl. No.: 75,953

[22] Filed: Jul. 21, 1987

[51] Int. Cl.[4] ..... B65B 43/52; B65B 5/04

[52] U.S. Cl. ..... 53/142; 53/575; 53/579; 53/244; 53/251; 493/163; 493/183

[58] Field of Search ..... 53/142, 244, 247, 251, 53/260, 575, 579; 493/163, 183

[56] References Cited

U.S. PATENT DOCUMENTS 2,196,666 4/1940 Moore ..... 53/575 X
2,760,318 8/1956 Brenneck ..... 53/142
4,616,475 10/1986 Nagata ..... 53/575

FOREIGN PATENT DOCUMENTS 2614709 10/1977 Fed. Rep. of Germany ..... 53/575
206085 7/1966 Sweden ..... 53/142

*Primary Examiner*—John Sipos
*Attorney, Agent, or Firm*—Fetherstonhaugh & Co.

[57] ABSTRACT

A machine for erecting, loading and closing an end loading carton. The machine has a dispenser station in which a knocked-down carton is removed from a storage magazine and deposited in the form of an open sleeve. A top closure station is provided in which the top closure flaps are folded along their hinge lines from their open position to their closed position. A collar flap tucking station is provided in which the collar flaps of the carton are folded inwardly. A loading station is provided in which load items are inserted through a loading opening in the top of the otherwise closed container. A load tamping station is provided in which the load items are tamped to permit the top closure flaps of the carton to assume a locking position with respect to the load item. A discharge station is provided in which loaded cartons are discharged from the carton support assemblies.

20 Claims, 8 Drawing Sheets

PACKAGING MACHINE

This invention relates to carton loading machines. In particular, this invention relates to a carton loading machine for loading lightbulbs into complex shipping packages which have bulb display windows.

PRIOR ART

Because of the increasing variety of different lightbulbs which are being manufactured, cartons have been designed for the purposes of shipping and storing these lightbulbs which have display windows which permit the purchaser to view the bulbous portion of the lightbulb and its connecting neck portion without the need to remove the bulbs from the carton. These cartons have the added advantage that they also provide a clear indication that a bulb is present and this tends to reduce theft because the removal of a bulb from its package is very evident from an examination of the package. These packages also have the advantage that they permit the purchaser to examine the filament of the lightbulb to determine whether or not it is intact at the time of purchase.

These lightbulb packages are, however, complex structures and considerable difficulty has been experienced in attempting to provide a carton loading mechanism which will permit the high speed loading of such cartons.

It is an object of the present invention to provide a carton loading machine for lightbulbs into complex cartons at high speed.

It is a further object of the present invention to provide a carton erecting and loading mechanism which is capable of erecting a complex end loading carton and loading it with a fragile load element at high speed.

According to one aspect of the present invention, there is provided a machine for loading electric light bulbs into a bulb storage compartment of a carton through a bulb receiving opening in the top of the carton comprising a load carrier having load support gates pivotally mounted thereon for movement between a first closed position forming a pocket for supporting the bulbous end of a lightbulb with its neck portion extending downwardly therefrom and a second position in which the gates are spaced from one another to a sufficient extent to form a downwardly opening discharge passage therebetween through which the bulbous end of the bulb may pass to be discharged from the carrier, carton support means for supporting a carton below the load carrier with its bulb receiving opening and bulb storage compartment aligned with said load carrier, gate opening means operable to move the gates between their open and closed positions, load transfer means mounted for movement between a first position spaced above a bulb located in the load carrier and the second position in which it positions a bulb in the bulb storage compartment located in the carton support means, pick-up means carried by the load transfer means, said pick-up means being operable, when located in close proximity to a lightbulb resting on the load support gates, before the gates are opened to pick the lightbulb up so that it is out of contact with said load carrier, such that after the gates are opened, the lightbulb is carried through the discharge opening without contacting said gates as it is transferred to the load storage compartment of a carton in use.

According to yet another aspect of the present invention, there is provided a machine for erecting an end loading carton of the type having; front, back and side panels hingedly connected to one another to form a sleeve within which a load storage compartment is formed, a top closure comprising front, back, leading and trailing top closure flaps hingedly connected to the front, back, leading and trailing walls respectively, along top closure hinge lines, said top closure flaps being foldable about said top closure hinge lines between an open position in-line with the side walls to provide an open loading passage opening into the load storage compartment and a closed position in which they extend inwardly of the load storage compartment, a carton support assembly comprising; a carton conveyor, a carton receptacle mounted on the carton conveyor, said receptacle having a back wall and a pair of side walls arranged to form a U-shaped compartment with the open side thereof opening laterally from the carton conveyor, said receptacle having an open upper end, stop means on the walls of the compartment for supporting the lower end of a carton located in said compartment in use, a fold backing member slidably mounted in each receptacle and providing movable folding edge over which said top closure may be folded, said fold backing member being proportioned to slide within a carton located in said carton receptacle between a retracted position located below the load storage compartment and an extended position underlying said top closure hinge lines during folding of said top closure flaps in use, and guide means for moving said fold backing member to and fro between said retracted and extended position in use.

According to a still further aspect of the present invention, there is provided a machine for erecting, loading and closing an end loading carton of the type having front, back, leading and trailing panels hingedly connected to one another to form a sleeve within which a load storage compartment is formed, a window opening formed in the front and back panels through which the load storage compartment may be viewed, front and back loading supporting collar flaps hingedly connected to the front and back walls respectively, along first transverse hinge lines, first corner hinge panels connecting the collar flaps to each side wall and serve to permit the collar flaps to move between a first position in-line with their associated front and back walls and a second position in which they are inclined inwardly of the container spaced to form support collars for a load item, and a top closure comprising front, back, leading and trailing top closure flaps hingedly connected to the front, back, leading and trailing walls respectively, along second transverse hinge lines, second corner hinge panels connecting adjacent ends of the front and side top closure flaps and adjacent ends of the back and side top closure flaps, said top closure flaps being foldable about said second hinge lines between an open position in-line with the side walls to provide an open loading passage opening into the load storage compartment and a closed position in which they extend inwardly and downwardly toward the load storage compartment, said machine comprising; a carton erecting and closing mechanism comprising; a carton conveyor, a plurality of carton support assemblies mounted on said carton conveyor, said carton conveyor being mounted for movement along an endless path which extends through; a transfer station in which a knocked-down carton is removed from a storage magazine and deposited in the form of an open sleeve, in a carton support assembly, a top closure station in which the top closure flaps are folded along the second hinge lines from their open position to their closed position, a collar flap tucking station in which the collar flaps are folded inwardly, a loading station in which load items are inserted through the loading opening, a load tamping station in which the load items are tamped to permit the top closure flaps to assume a locking position with respect to the load item, a discharge station in which loaded cartons are discharged from the carton support assemblies, said carton support assembly comprising a carton receptacle mounted on the carton conveyor, said receptacle having a back wall and a pair of side walls arranged to form a U-shaped compartment with the open side thereof opening laterally from the carton conveyor, said receptacle having an open upper end, stop means on the walls of the compartment for supporting the lower end of a carton located in said compartment in use, a fold backing member slidably mounted in each receptacle, said fold backing member having folding edge over which various flaps and panels may be folded along their fold lines, first guide means extending through each station and communicating with the fold backing member for controlling the position of each fold backing member with respect to its associated receptacle, a retaining rail extending from the output end of the transfer station to the input end of the discharge station in a position disposed opposite the open side of the U-shaped receptacle to retain a carton therein, a top closure mechanism in said top closure station comprising kicker blade means mounted for rotation above the top closure station, said kicker blade means engaging the trailing top closure flap to fold it from its open position to its closed position, a first plow blade extending above the top closure station for plowing the leading top closure flap from its open position to its closed position and front and back plow blades extending above the top closure station, downstream of the first plow to fold the front and back top closure flaps from their first position to their second position in which they overlie the side flaps, first tamping means mounted above the top closure station for movement toward and away from the closed top end of a carton located in the top closure station to depress the top closure flap to a sufficient extent to cause the comer hinges to apply a downwardly biasing load to the top closure flaps which retains the top closure flaps in a slight downwardly biased position, at each side of the loading opening, said first guide means being arranged to cause the fold backing member to be elevated to locate the folding edge thereof inwardly of the first transverse hinge lines to provide a backing over which the collar flaps may be folded, collar flap tucking means in said tucking station comprising; front and back tucking blades mounted to reciprocate to and fro between a retracted position disposed opposite and spaced outwardly from the front and back collar flaps and an extended position located inwardly of the front and back walls of a carton located in said tucking station to fold the front and back collar flaps inwardly along their hinge connection, said back-up guide means serving to locate said back-up means in a position to back-up the front and back walls of the carton immediately below the collar flap hinges, a load transporting mechanism comprising a load transporting conveyor, a plurality of load transporting heads mounted on said conveyor, drive means for driving the load transport conveyor to locate successive load transporting heads in and to transport them through a receiving station in which load items are located on each head and said loading station in which load items are transferred from the transporting heads to the load storage compartment of a carton, said load transporting heads each comprising, a backing member, a pair of load support gates each having an upper end and a lower end, said gates being pivotally mounted on said backing member for movement between a first position in which they co-operated with one another to form an upwardly open load support pocket therebetween, and a second position in which the lower ends of the gates are spaced from one another to a sufficient extent to form a discharge passage therebetween through which the load may be discharged in use, a lever arm mounted on each support gate outwardly from the load support pocket, said lever arms projecting toward one another, one on either side of an actuator path which extends longitudinally therebetween, biasing means resiliently biasing said support gates to said first position, load transfer means in said loading station comprising a stationary support, a carriage slidably mounted on the stationary support for movement between a raised position and a lowered position, first actuator means for moving said carriage to and fro between said raised and lowered position, second actuator means mounted on the carriage, pickup means mounted on said second actuator means for movement with and relative to the carriage toward and away from a load located in a pocket of a load carrier aligned therewith in the load transfer station, said pickup means being operable when located in close proximity to the load to raise the load a short distance to unseat it with respect to said pocket, gate opening means mounted on said second actuator means for movement between an extended position and a retracted position with respect to said receptacle to engage said lever means as it moves toward said extended position to cause the gates to pivot from their first position to their second position, said second actuator means displacing the pickup means to a sufficient extent after unseating the load to drive the load downwardly through the discharge passage formed between the lower ends of the gates and through said loading passage formed in the top closure of a carton located in said loading station, and second tamping means mounted in said load tamping station for movement between a raised position located above a load in a load storage compartment of a carton and second position engaging said load and depressing it into the load storage compartment to a sufficient extent to release the top closure flaps to allow them to assume a position in which they narrow the loading passage to prevent the removal of the load therethrough, and discharge means in the discharge station for discharging loaded cartons from said carton conveyor.

The invention will be more clearly understood after reference to the following detailed specification read in conjunction with the drawings wherein.

Figure 1:
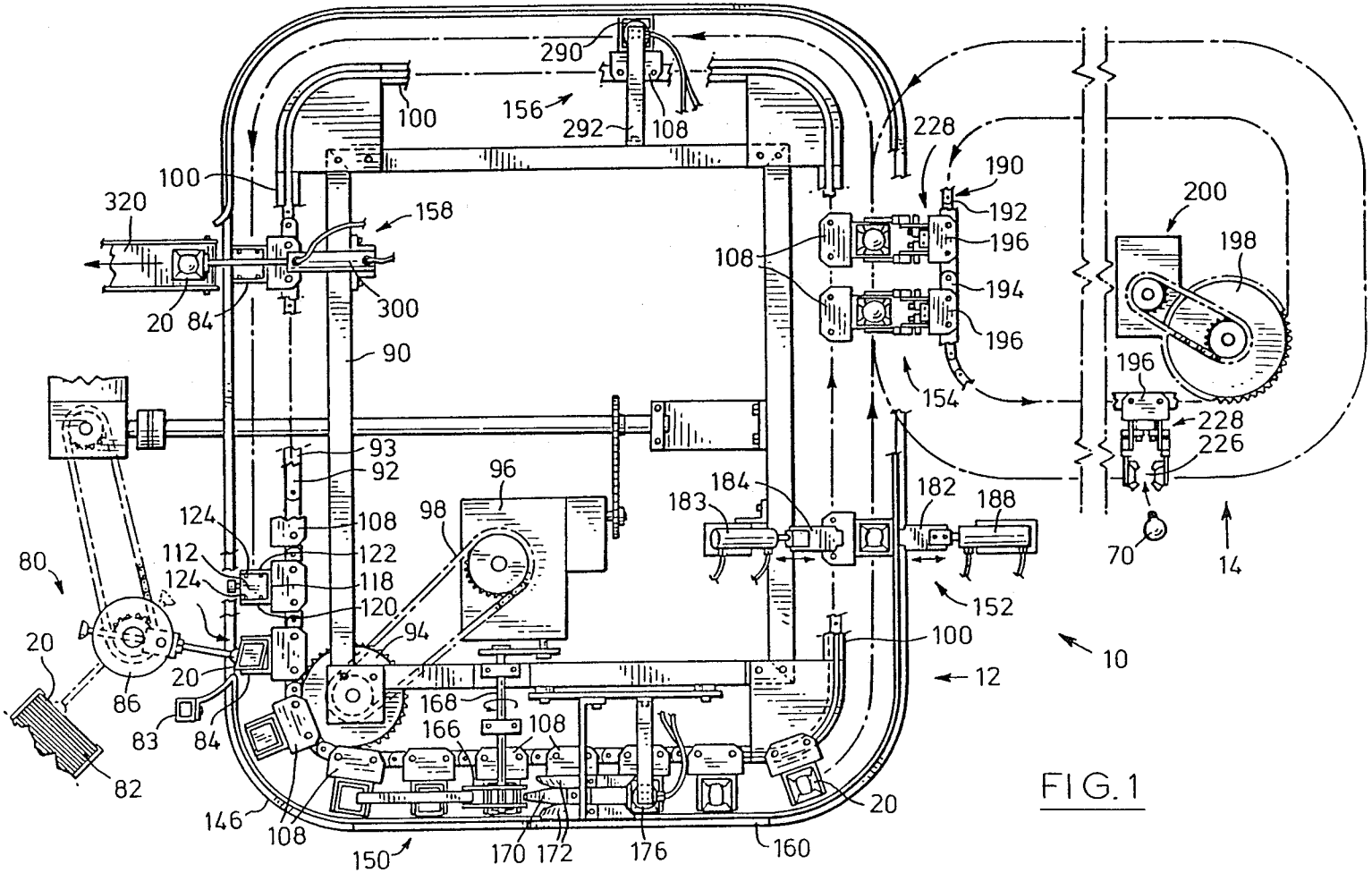
FIG. 1 is a plan view of a carton loading machine constructed in accordance with an embodiment of the present invention.

With reference to FIG. 1 of the drawings, the reference numeral 10 refers generally to a carton loading machine constructed in accordance with an embodiment of the present invention.

Figure 8:
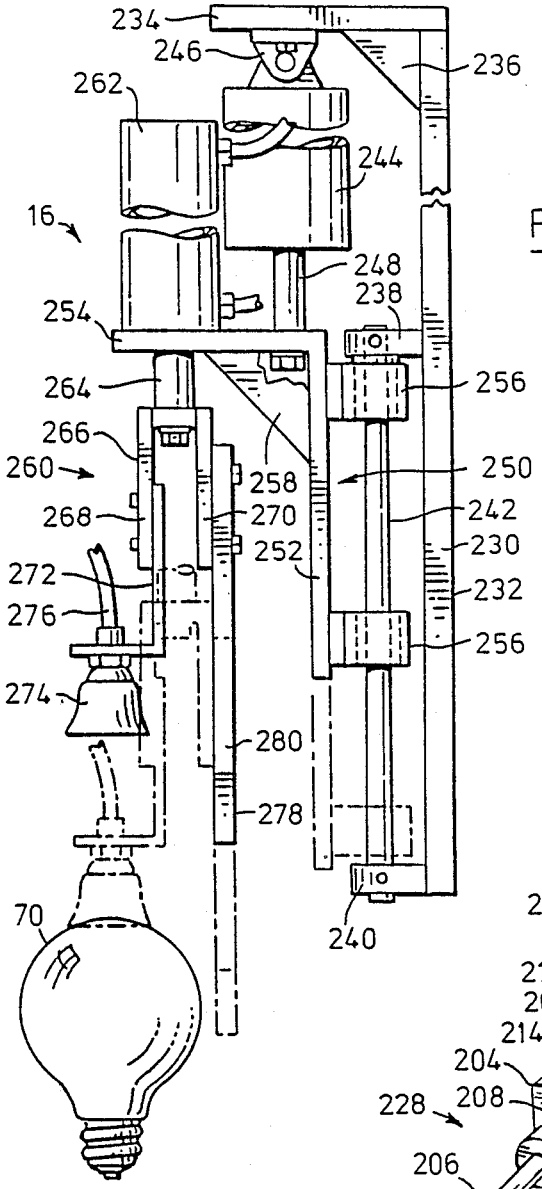
FIG. 8 is a side view taken along the line 8—8 of FIG. 7.

The carton loading machine 10 includes carton erecting and closing mechanism 12, a load transporting mechanism 14 and a load transfer mechanism 16 (FIG. 8).

Figure 4:
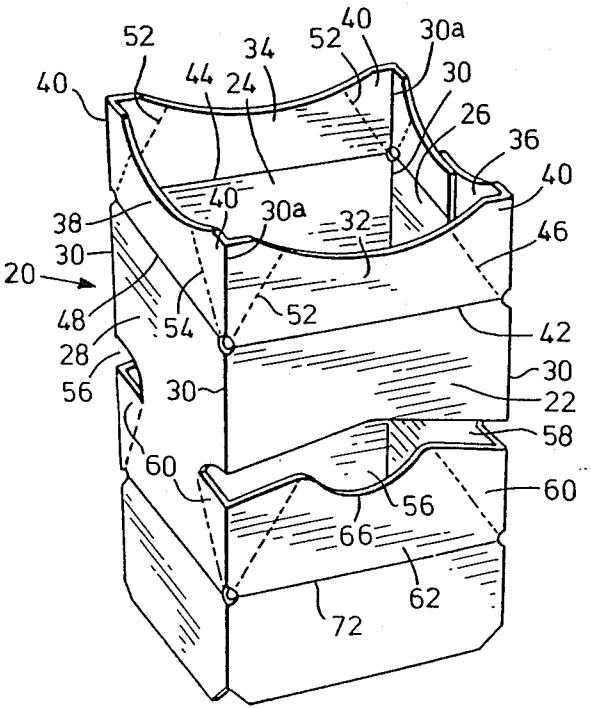
FIG. 4 is a pictorial view of a carton of the type loaded by the carton loading machine of the present invention in an open configuration.

The carton which is to be loaded is illustrated in FIG. 4 of the drawings and is generally identified by the reference numeral 20. The carton 20 has a front wall 22, a back wall 24, a leading side wall 26 and a trailing side wall 28 which are hingedly connected to one another along longitudinal hinge lines 30. The carton 20 also has a top closure which comprises a front flap 32, a back flap 34, a leading side flap 36 and a trailing side flap 38 which are hingedly connected to the front panel 22, back panel 24, leading side panel 26 and trailing side panel 28 along first transverse hinge lines 42, 44, 46 and 48 respectively. Corner hinge panels 40 connect the adjacent ends of the top closure panels. Each corner hinge panel 40 includes a central hinge line 30*a* which is an extension of the longitudinal hinge line 30 and first and second corner hinge lines 52 and 54. The hinge lines 52 are formed in the front and back closure flaps and the hinge lines 54 are formed in the leading and trailing top closure flaps 36 and 38 respectively. The angle of inclination of the hinge line 52 with respect to the hinge line 30*a* is greater than that of the hinge line 54 with respect to the hinge line 30*a*.

The carton also has window openings 56 formed therein through which a load which is positioned in the carton may be viewed. The carton 20 also has front and back load supporting collar flaps 62 and 64 (FIG. 11) which are hingedly connected to the front wall 22 along second hinge lines 72 and 74. Each front load supporting collar flap is formed with an arcuate-shaped recess 66. Corner hinge panels 60 serve to hingedly connect the front and back load supporting collar flaps to the leading and trailing side walls of the carton, the corner hinge panels 60 are constructed similar to the corner hinge panels 40 and will not therefore be described in detail.

Figure 5:
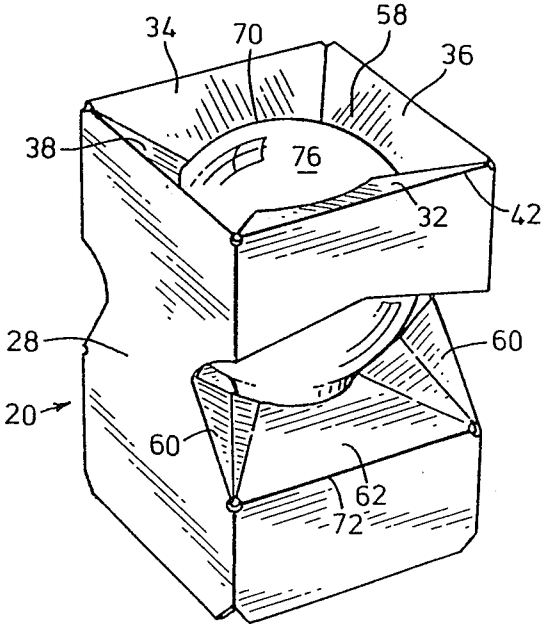
FIG. 5 is a pictorial view of the carton of FIG. 4 in its loaded and closed configuration.

FIG. 5 illustrates the carton of FIG. 4 in its loaded configuration with an electric lightbulb 70 located in the load storage compartment 58 which is formed when the carton is erected as will be described hereinafter. As shown in FIG. 5, the bulbous portion 76 of the lightbulb is retained from below by the inwardly directed front and back load supporting collar flaps 62 and 64 and the upper end is retained by the inwardly and downwardly directed flaps 32, 34, 36 and 38.

With reference to FIG. 1 of the drawings, the reference numeral 80 refers generally to a carton dispenser station in which knocked-down carton blanks are removed from a carton storage magazine 82, are opened and are transferred to the carton receptacles 84 by means of a rotary transfer mechanism 86. A rotary transfer mechanism of this type is well known and is described in U.S. Pat. No. 3,937,458 dated Feb. 10, 1976 and will not therefore be described in detail.

The carton erecting and closing mechanism 12 includes a frame 90 on which a pair of endless chains 92 and 93 are mounted for movement along a generally rectangular path. A sprocket 94 is mounted on the frame 90 and serves as a driven sprocket which drives the chain 92. The sprocket 94 is driven by an electric motor through a reduction gear 96 by means of a drive chain 98.

Figure 2:
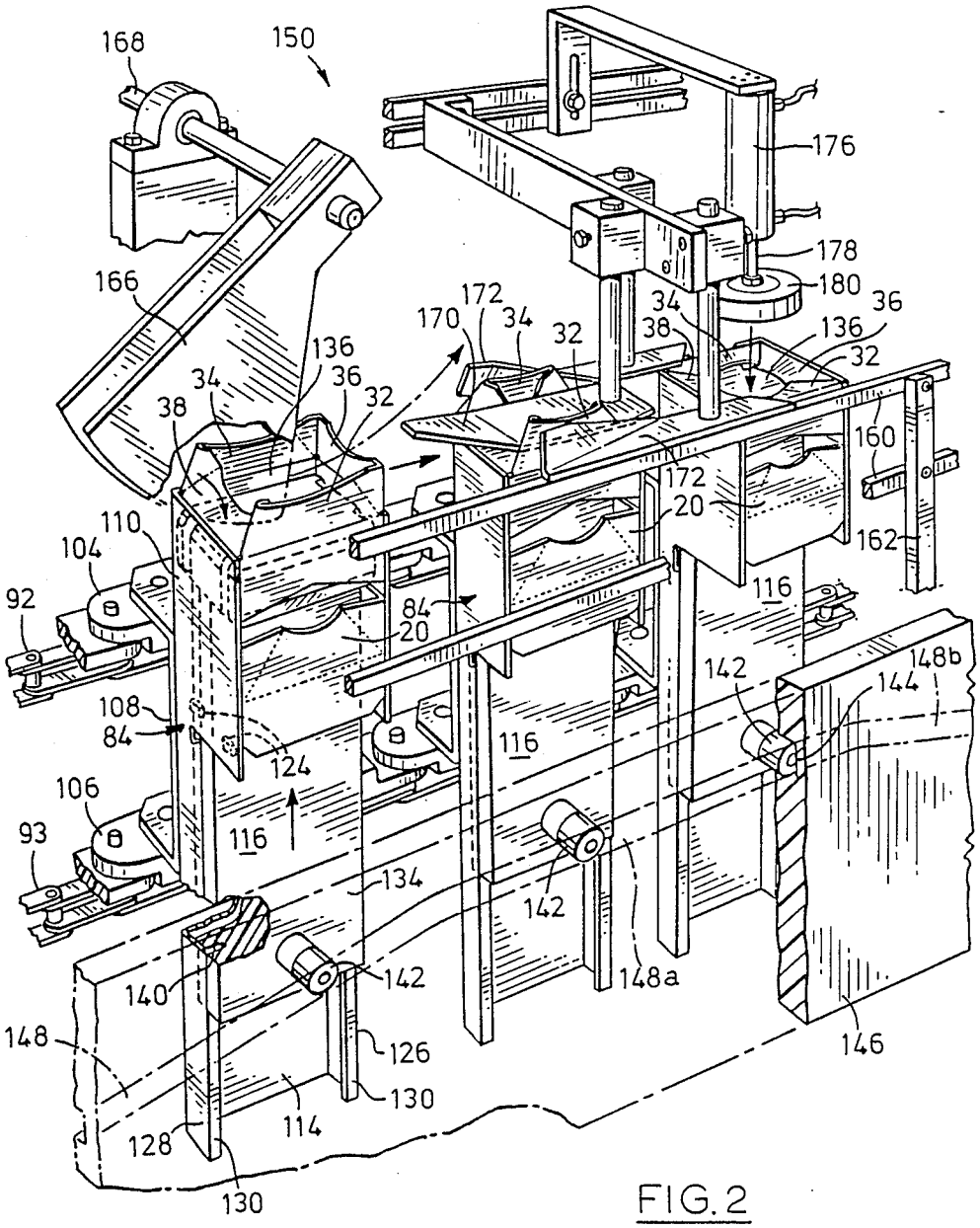
FIG. 2 is a pictorial view of the top closure mechanism of FIG. 1 taken in the direction of the arrow 2 of FIG. 1.
Figure 3:
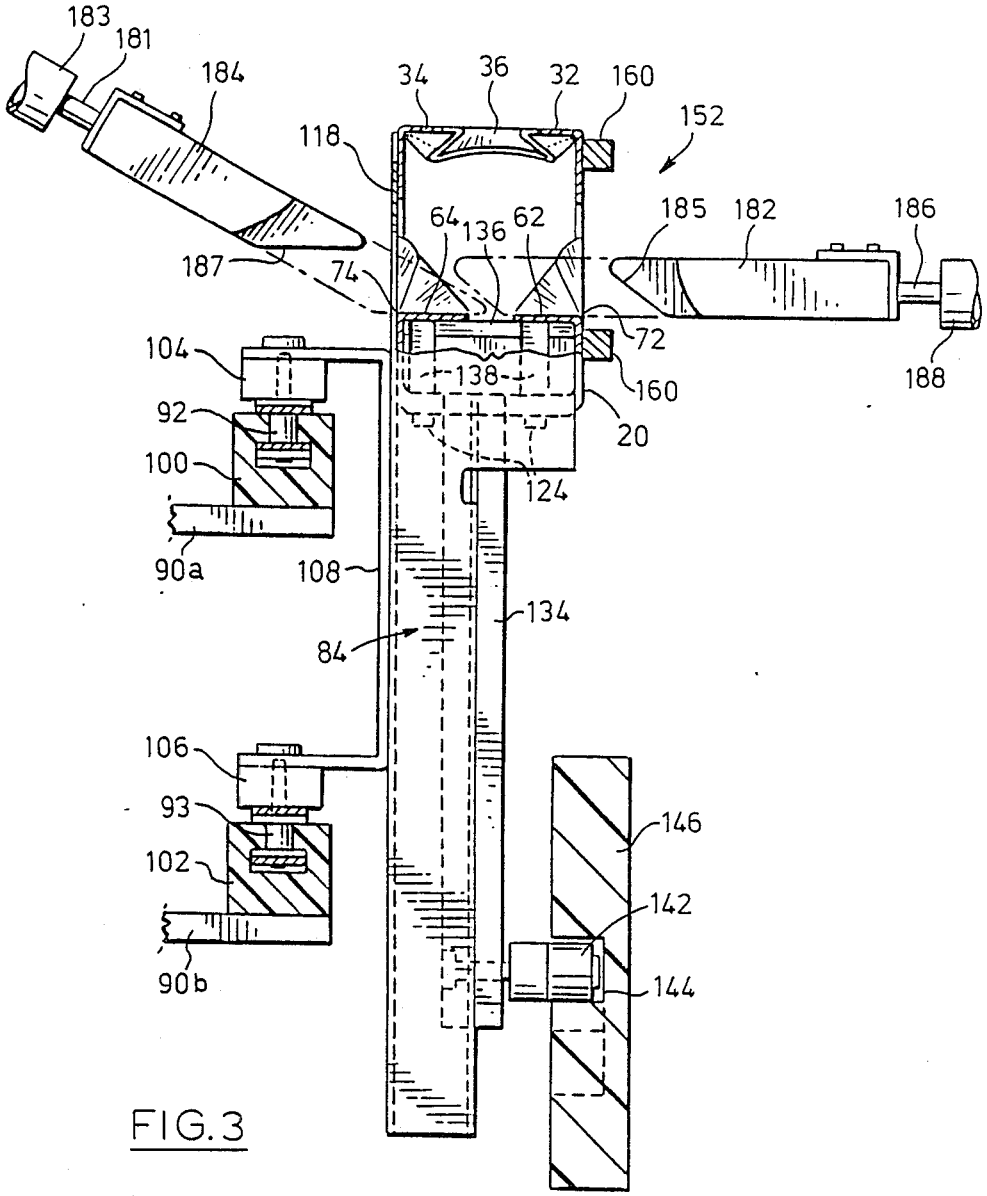
FIG. 3 is a sectional view taken along the line 3—3 of FIG. 1 illustrating the tucking station.

As shown in FIGS. 2 and 3 of the drawings, the chains 92 and 93 are supported in guide tracks 100 and 102 respectively which are carried by the frame members 90*a* and 90*b*. Support blocks 104 and 106 are mounted on the chains 92 and 93 respectively and a U-shaped bridge plate 108 is mounted on and extends vertically between the support blocks 104 and 106. The carton receptacles 84 are each mounted on a bridge plate 108.

Each receptacle 84 has an upper end portion 110 in which the carton receiving compartment 112 (FIG. 1) is formed and a lower portion 114 which forms a slipway for a fold backing member 116. The upper end portion 110 has a back wall 118, a leading side wall 120 and a trailing side wall 122. Two small lugs 124 are mounted on the leading wall 122 and two similar small lugs 124 are mounted on the trailing wall 122. The lugs 124 form shoulders which support the lower edge of the side walls of the carton in the carton receiving compartment 122.

The lower portion 114 has leading and trailing side walls 126 and 128 respectively, each of which are formed with short inwardly directed flanges 130.

As shown in FIG. 3 of the drawings, an opening 132 is formed in the back wall 118.

The fold backing member 116 comprises a body of plastics material which has a low co-efficient of friction. The fold backing member 116 has an elongated lower portion 134 and a head portion 136. The head portion 136 has longitudinally extending grooves 138 formed therein to accommodate the lugs 124. The lower portion has longitudinally extending grooves 140 formed therein to accommodate the flanges 130. A follower roller 142 is mounted on each fold backing member 116 adjacent the lower end of the lower portion 134 and extends into a guide track 144 formed in a guide rail 146 which extends continuously about the perimeter of the carton loading machine.

The cartons are retained in the carton receptacles 84 as the receptacles are driven from the dispenser station 80 through the top closure station 150, a collar flap tucking station 152, loading station 154, load tamping station 156 to a point just short of the load discharge station 158 by means of a pair of spaced retaining rails 160 which are supported in a spaced relationship by support posts 162 which are mounted on the main frame of the machine.

In the top closure station 150, a kicker blade 166 is mounted for rotation on a drive shaft 168 and serves to engage the trailing side flap 38 to fold it inwardly as shown in FIG. 2. Thereafter, as the carton receptacle 80 is indexed to the second location in the top closure station 150, the top plow bar 170 serves to plow the leading side flap 36 inwardly. In addition, the side plow blades 172 serve to fold the front and back flaps 32 and 34 into a closing position as shown in FIG. 2.

In order to ensure that the top closure flaps 32, 34, 36 and 38 will assume a downwardly and inwardly inclined position, a tamping head 180 is provided in the third location of the top closure station 150. The tamping head 180 is mounted on a shaft 178 of a pneumatic cylinder 176 for movement toward and away from the top closure flaps. By activating the pneumatic cylinder 176, the shaft 178 is driven to cause the tamping head 180 to move into contact with the top closure flaps and to force them into a position in which they are inclined downwardly and inwardly of the load storage compartment. When in this position, the corner hinge panels will tend to open out and will serve to retain the top closure flaps in this downwardly inclined configuration.

It will be noted that as the carton receptacles 84 are indexed into the first location in the top closure station, the follower rollers 142 travel along the inclined portion 148 of the guide track 144 and consequently, the head portions 136 of the fold backing members 116 are elevated into close proximity with the top closure flaps so as to support the front, back and side walls of the carton during the closing operation.

During travel through the second and third locations, the followers 42 extend along the horizontal portion **148*a* of the guide track 140 and only start to the upper end of their associated carton as the carton receptacles 84 move away from the first tamping location and the guide rollers 142 travel along the downwardly inclined portions 148*b*** of the guide track.

The carton receptacles are indexed through a series of different locations and eventually arrive at the collar flap tucking station 152. As shown in FIG. 3 of the drawings, when the carton receptacle 84 is located in the tucking station 152, the head portion 136 of the fold backing member 116 is elevated to a position closely adjacent the second hinge line 72, 74 of the carton.

Front and back tucking blades 182 and 184 are provided in the tucking station 152 for the purposes of folding and tucking the front and back collar flaps 62 and 64 inwardly. The front tucking blade 182 is mounted on the shaft 186 of a pneumatic cylinder 188. The back tucking blade 184 is mounted on the shaft 181 of a pneumatic cylinder 183. The front tucking blade 182 is mounted to reciprocate in a horizontal plane and has a leading face 185 which is inclined upwardly and forwardly. The back tucking blade 184 is mounted to reciprocate in a plane which is inclined downwardly and inwardly and has a leading face 187 which is horizontally oriented. By reason of the different orientation of the planes in which the front and back tucking blades 182 and 184 are caused to reciprocate, it is possible to have the inner ends of these blades arranged to overlap one another when in the inwardly extended position. By locating the head portion 136 of the fold backing member 116 in the intermediate position shown in FIG. 3 of the drawing, it serves to cooperate with the tucking blades 182 and 184 to ensure that the collar flaps 62 and 64 will fold inwardly along the fold lines 72 and 74 and will be set in this inwardly inclined position. It will also be noted that the proportions of the corner hinge panels are such that when the collar flaps 62 and 64 are in their extended position shown in FIG. 3, the corner hinge panels will be folded to a fully open position and will serve to retain the collar flaps in their inwardly directed position.

The carton receptacles with the preformed cartons located therein will then be indexed into the carton loading station. In the embodiment illustrated in FIG. 1 of the drawings, two carton loading locations are provided in the carton loading station.

In the carton loading station 154, the load transporting mechanism and the carton erecting and closing mechanism are aligned with one another as illustrated in FIG. 1.

Load Transporting Mechanism

The load transporting mechanism 14 will now be described with reference to FIGS. 1 and 6 of the drawings. The load transporting mechanism 14 includes a conveyor 190 which consists of a pair of chains 192 (only one of which is shown) which are arranged one above the other. Support blocks 194 are mounted on the chains 192 and a U-shaped backing plate 196 extends between the chains 192 and is mounted on the support lugs 194. The chains 192 are driven by a sprocket 198 from a power source 200.

Figure 6:
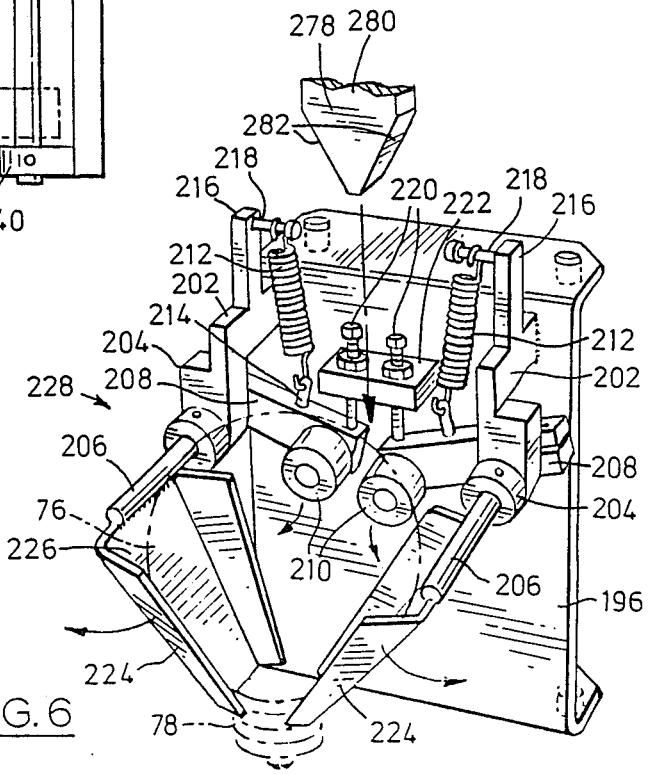
FIG. 6 is a pictorial view of a bulb carrier head constructed in accordance with an embodiment of the present invention.

As shown in FIG. 6 of the drawings, a pair of arms 202 are mounted on each backing plate 196 and project outwardly therefrom. The arms 202 have downwardly projecting extensions 204 which are arranged in a spaced relationship with respect to the backing plate 196. A shaft 206 is pivotally mounted in each extension 204 and extends longitudinally therethrough to project into the gap formed between the extensions 204 and the backing plate 196. A lever arm 208 has its proximal end clamped to the inner end portion of the shaft 206 and has a roller 210 mounted for rotation at its distal ends. Tension springs 212 have one end anchored on a lug 214 mounted on the lever arm 208 and their other end anchored on a pin 218 which projects from a post 216 which extends upwardly from the arm 202. The tension springs 212 serve to normally urge the lever arms 208 to the position in which the distal ends thereof bear against the adjustable stop screws 220 which are threaded in a support block 222 which is mounted on the backing plate 196.

A pair of oppositely disposed gates 224 are mounted on and project downwardly from the shafts 206. The gates 204 each have a generally U-shaped cross-section which decreases progressively in width from the upper end thereof to the lower end thereof. When the gates 224 are located in the closed position shown in FIG. 6 of the drawing, they cooperate with one another to form an article receiving pocket 226 which is proportioned to receive the bulbous portion 76 of an electric lightbulb therein with the terminal neck portion 78 thereof extending downwardly therefrom.

The gates 224 can be opened to permit the bulb 70 to pass downwardly therebetween by deflecting the rollers 210 away from one another and this is achieved by the load transfer mechanism 16.

Load Transfer Mechanism

Figure 7:
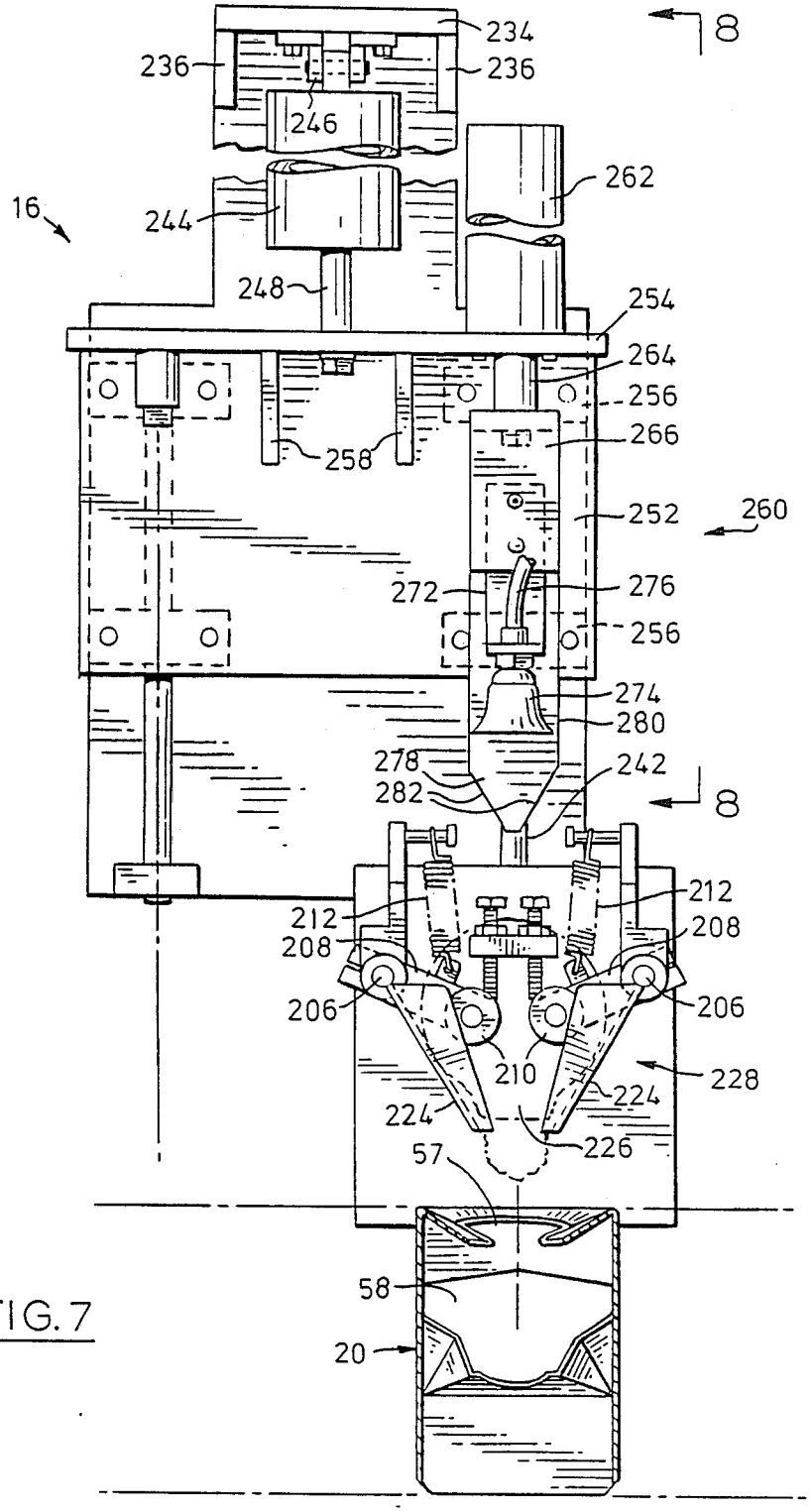
FIG. 7 is a front view of the load transfer mechanism for transferring a lightbulb from its carrier into a carton.

The load transfer mechanism 16 will now be described with reference to FIGS. 7 and 8 of the drawings. The load transfer mechanism includes a stationary support 230 which is mounted on the main frame of the load transfer mechanism (not shown) so as to extend above the load transporting assemblies 228. The stationary support 230 includes a vertically oriented support plate 232 and a top plate 234 which projects forwardly from the plate 232 and is raised by means of gusset members 236. Support members 238 and 240 are mounted on and project forwardly from the support plate 232. Guide shafts 242 extend longitudinally between the support members 238 and 240. A first actuator in the form of a pneumatic cylinder 244 has one end pivotally mounted in a support hanger 246 which is supported by the top plate 234. An L-shaped carriage 250 is mounted on the shaft 248 of the pneumatic cylinder 244 so as to be movable in response to extension and retraction of the shaft 248 with respect to the pneumatic cylinder 244 between the positions shown in solid lines and the position shown in broken lines in FIG. 8. The L-shaped carriage 250 has a vertical plate 252 and a horizontal plate 254. Bearings 256 are mounted on the vertical plate 252 and are slidably mounted on the guide shafts 242. Gusset plates 258 serve to brace the horizontal plate 256 with respect to the vertical plate 254.

A pair of second actuator assemblies 260 are mounted on the carriage 250, one aligned with each carton loading location. Each second actuator 260 includes a pneumatic cylinder 262 which is mounted on the horizontal plate 252. The second actuator assemblies 260 are identical and consequently only one will be described in detail. The pneumatic cylinders 262 have a drive shaft 264 which extends downwardly therefrom. The drive shaft 264 can be reciprocally driven by the pneumatic cylinder 262. A U-shaped hanger 266 is mounted on the shaft 264. The hanger 266 has a front arm 268 and a back arm 270 extending downwardly therefrom. An L-shaped bracket 272 is mounted on the front arm 268 and extends downwardly therefrom. A suction cup 274 is mounted on the bracket 272 and has a conduit 276 extending therefrom to communicate with a vacuum source. The suction cup 274 is made from a resiliently flexible material and has a vacuum passage opening therethrough which communicates with the vacuum conduit 276.

A gate opening wedge plate 280 is mounted on the back arm 270 of the U-shaped hanger 266 and projects downwardly therefrom. The lower end 278 of the wedge-plate 280 is V-shaped and has angularly inclined side faces 282 which are aligned with the rollers 210 of the load transporting assemblies 228 which are located in the loading locations in the loading stations.

In use, when a lightbulb 70 is to be transferred from the load transporting assembly 228 into a preformed carton 20, the first actuator in the form of the pneumatic cylinder 244 is activated to cause the carriage 250 to move from the position shown in solid lines in FIG. 8 to the position shown in broken lines. As a result, the suction cup 274 is moved toward the lightbulb 70. The position of the suction cup 274 with respect to the wedge 280 is predetermined in order to ensure that a suction cup 274 will be located in close proximity to the bulbous end of a bulb 70 so that it will be effective to raise the bulb 70 into contact therewith before the lower end 278 of the gate opening wedge plate 280 engages the rollers 210. As a result, the suction cup 274 will function as a pick-up means which will raise the bulb 70 out of contact with the gates 224. Thereafter, the second actuator mechanism in the form of the pneumatic cylinders 262 will be activated to simultaneously move the suction cup 274 and the gate opening wedge plate 280 from the position shown in solid lines to the position shown in broken lines in FIG. 8. This movement of the gate opening wedge plate 280 causes the gates 224 to open in advance of the bulb 70 which is carried by the suction cup 274 so that the bulb will pass downwardly between the gates out of contact with the gates. Thus, no pressure is applied to the bulbous end of the lightbulb by reason of the passage of the lightbulb through the open gates. Continued downward movement of the second actuator means will cause the lightbulb to be driven through the inward opening 57 of the carton into the load storage compartment 58 to be seated therein as shown in FIG. 10 of the drawings.

Figures 9, 10, 11, 12:
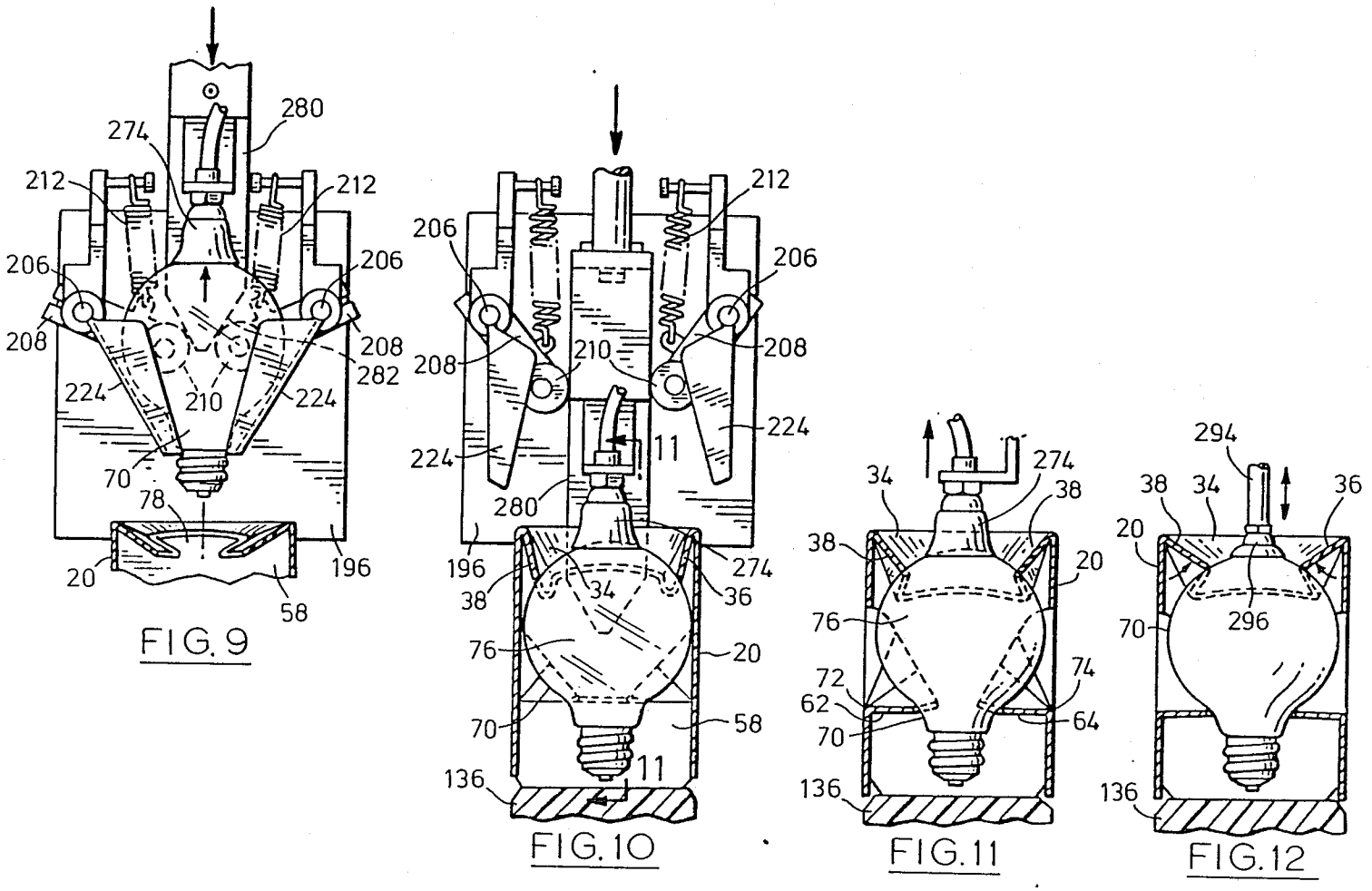
FIG. 9 is a front view of the load carrier head of FIG. 6 illustrating a first step in the transfer.
FIG. 10 is a view similar to FIG. 9 showing a further step in the load transfer.
FIG. 11 is a side view taken along the line 11—11 of FIG. 10.
FIG. 12 is view similar to FIG. 11 showing the final load tamping step.
Figure 13:
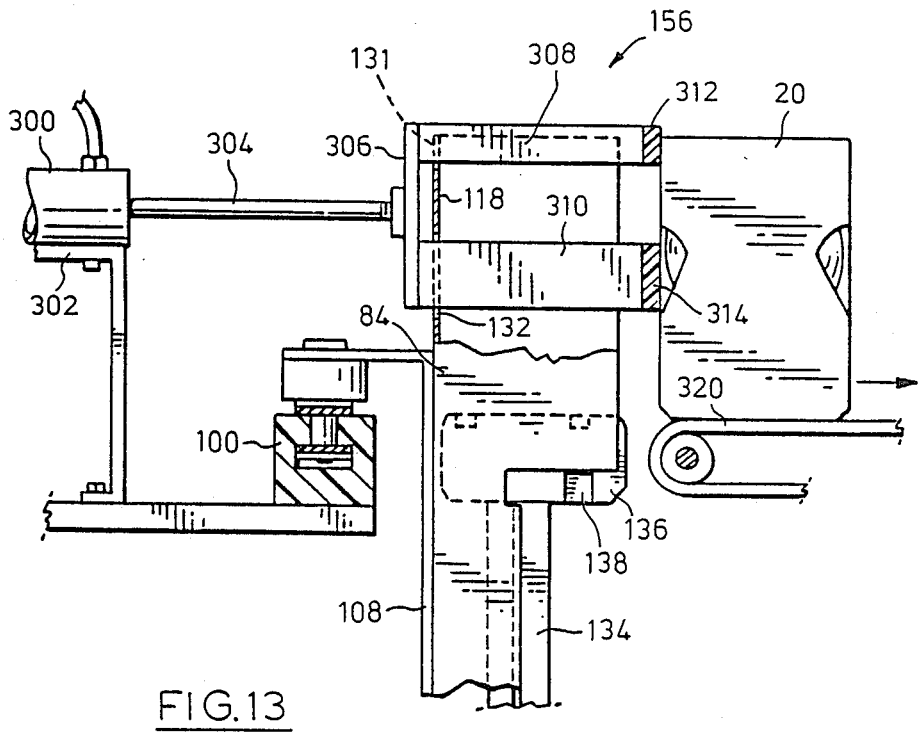
FIG. 13 is a sectional view taken along the line 13—13 of FIG. 1 showing the discharge station.

As shown in FIGS. 10 and 11 of the drawings, the top closure flaps will initially be deflected outwardly toward the bulbous portion 76 of the bulb to pass through the loading opening 78. When the widest portion of the bulbous portion 76 passes below the top wall flaps, they will tend to recover to the position shown in FIG. 11 in which the lower edges thereof will bear against the upwardly directed surface of the bulbous portion 76. After the bulb is located in the position shown in FIG. 11, the vacuum which is drawn through the suction cup is relieved and the suction cup 274 is raised out of contact with the bulb 70.

The loaded carton is then indexed to the second tamping station 156. In the second tamping station 156, a pneumatic cylinder 290 (FIG. 1) is supported by means of a support bracket 292 with its reciprocating shaft 294 (FIG. 12) mounted to reciprocate toward and away from a bulb 70. A pressure pad 296 is located at the lower end of the shaft 294. The pressure pad 296 is driven against the bulb 70 to tamp the bulb 70 downwardly slightly so as to permit the top closure flaps 32, 34, 36 and 38 to move slightly further inwardly to further reduce the size of the loading passage 78. This slight inward movement occurs automatically when the bulb is lowered because of the reasserting forces applied by the corner hinge panel. This serves to "set up" the top closure panel to a position in which they are locked. Any attempt to force the bulb out of the storage compartment through the loading end 78 would drive the bulb 70 against the leading and trailing closure flaps and this force which would tend to raise the leading and trailing flaps 36 would be applied to the front and back closure flaps 32, 34 through the corner hinge panels. This would, however, result in inward movement of the front and back closure flaps which would only tend to reduce the size of the discharge passage. These characteristics of this type of carton are well known and will not therefore be described in greater detail.

Having seated the bulb in the required position within the carton, the loaded cartons are then indexed to the discharge station 158.

Discharge Station

As shown in FIGS. 1 anc 13 of the drawings, a pneumatic cylinder 300 is mounted on a support bracket 302. The cylinder 300 has a shaft 304 mounted therein which can be driven to and fro toward and away from the carton receptacle 84 which is located in the discharge station. The shaft 304 has a pusher head 306 mounted at its outer end. The pusher head 306 has an upper arm 308 and a lower arm 310 projecting outwardly therefrom. The upper arm 308 has an upper pusher bar 312 and the lower arm 310 has a lower pusher bar 314 extending transversely thereof. The arm 308 and pusher bar 312 are proportioned to extend through the notch 131 which is formed at the upper end of the back wall 118 of the carton receptacle 84 and the arm 130 and pusher bar 314 are proportioned to pass through the opening 132 in the back wall 118. The pneumatic cylinder 300 is operable to cause the pusher head 306 to move the pusher bars 312 and 314 into engagement with a loaded carton to cause it to push the loaded carton 20 out of the receptacle 84 and onto a discharge conveyor 320 which is operable to transport the loaded cartons away from the carton loading machine.

In use, knock down carton blanks are loaded into the carton storage magazine 82 and bulbs 70 are located in the load transporting heads of the load transporting conveyor in any conventional manner. The bulbs 70 may be manually loaded or they may be directed through a loading chute.

As a first carton receptacle 84 is advanced into the carton transfer station 80, a carton is withdrawn from the magazine by the rotary mechanism 86 and is driven against an opening bar 83 to assume a partially opened position and is then located within the receptacle 84 in the open configuration illustrated in FIG. 1. The receptacles 84 are then further indexed to pass through the top closure station which as previously described serves to kick the trailing top closure flap inwardly and then plow the leading top closure flap 36 inwardly and thereafter to plow the front and back closure flaps inwardly as shown in FIG. 2. In advance of the kicking and plowing operation, the fold backing member 116 is elevated within the open carton to a point closely adjacent the first transverse fold lines so as to offer support for the front, back and side walls of the carton during the folding operation. A first tamping operation is carried out in the third location of the top closure station in which the tamping head 180 is driven downwardly into contact with the top closure flaps to ensure that the leading and trailing flaps are downwardly inclined and assume a position shown in FIG. 3.

The carton receptacles 84 are then indexed into the tucking station 152. In the tucking station 152, the tucking bars 182 and 184 are activated to fold the front and back tucking collar flaps 62 and 64 inwardly to assume the position shown in FIG. 3 of the drawings.

The carton receptacles 84 are then indexed into the carton loading station 154 in which two carton loading receptacles 84 will be positioned for loading with a lightbulb as shown in FIG. 1.

The lightbulbs which are supported by the load transporting heads which are positioned in the two loading locations are then transferred from the load transporting heads into the underlying cartons by sequentially activating the first and second activator cylinders 244 and 262 to initially pickup the bulb and then open the gates as the bulb is lowered through the loading passage into the load storage compartment of an underlying carton.

The loaded cartons are then indexed one at a time into the tamping station 156 in which the tamping cylinder 290 is activated to cause the tamping head 296 to press the bulb 70 downwardly to allow the locking flaps to reassert themselves as previously described. The carton receptacles 84 are then indexed into the discharge station wherein the loaded cartons are discharged by activating the pneumatic cylinder 300 to cause the pusher blades 312 and 314 to drive the loaded carton out of the receptacle onto the conveyor 320.

Various modifications of the present invention will be apparent to those skilled in the art.

We claim:

1. A machine for loading electric light bulbs into a bulb storage compartment of a carton through a bulb receiving opening in the top of the carton comprising;

(a) a load carrier having load support gates pivotally mounted thereon for movement between a first closed position forming a pocket for supporting the bulbous end of a lightbulb with its neck portion extending downwardly therefrom and a second position in which the gates are spaced from one another to a sufficient extent to form a downwardly opening discharge passage therebetween through which the bulbous end of the bulb may pass to be discharged from the carrier, (b) carton support means for supporting a carton below the load carrier with its bulb receiving opening and bulb storage compartment aligned with said load carrier, (c) gate opening means operable to move the gates between their open and closed positions, (d) load transfer means mounted for movement between a first position spaced above a bulb located in the load carrier and the second position in which it positions a bulb in the bulb storage compartment located in the carton support means, (e) pick-up means carried by the load transfer means for raising a lightbulb which is resting on the load support gates until it is out of contact with the load support gates before the load support gates are opened, such that after the gates are opened, the lightbulb is carried through the discharge opening without contacting said gates as it is transferred to the load storage compartment of a carton in use.

2. A machine as claimed in claim 1, wherein each gate has a lever arm mounted thereon, said lever arms projecting one on either side of an actuator path which extends longitudinally therebetween and wherein said gate opening means comprises a first actuator mounted for movement along said actuator path between a retracted position spaced from said lever arms and an extended position in which it deflects said lever arms to an extent sufficient to move the gates from said closed position to said open position.

3. A machine as claimed in claim 1, wherein said pickup means includes a suction cup and means for drawing a vacuum in the suction cup to draw the bulbous end of the lightbulb upwardly into contact therewith.

4. A machine as claimed in claim 1, wherein said load transfer means comprises a carriage slidably mounted for movement between a raised position and a lowered position with respect to said carton support means, first carriage actuator means for moving said carriage to and fro between said raised and lowered positions, second actuator means mounted on said carriage, said pickup means being mounted on said second actuator means for movement with and relative to said carriage between said first and second positions, said gate opening means being mounted on said second actuator means for movement between an extended position and a retracted position with respect to said receptacle to engage said lever arms as it moves toward said extended position to cause said gates to move from said first closed position to said second open position.

5. A machine as claimed in claim 4, further comprising load tamping means mounted in a load tamping station for movement between a raised position located above a load in a load storage compartment of a carton and a second position engaging said load and depressing it into the load storage compartment to a sufficient extent to release top closure flaps of the carton to allow them to assume a position in which they narrow the loading passage to prevent the removal of the load therethrough.

6. A machine as claimed in claim 1, wherein said carton support means comprises (a) a carton conveyor, (b) a carton receptacle mounted on the carton conveyor, said receptacle having a back wall and a pair of side walls arranged to form a U-shaped compartment with the open side thereof opening laterally from the carton conveyor, said receptacle having an open upper end, (c) stop means on the walls of the compartment for supporting the lower end of a carton located in said compartment in use, (d) a fold backing member slidably mounted in each receptacle and providing movable folding edge over which said top closure may be folded, said fold backing member being proportioned to slide within a carton located in said carton receptacle between a retracted position located below the load storage compartment and an extended position underlying said top closure hinge lines during folding of said top closure flaps in use, and (e) guide means for moving said fold backing member to and fro between said retracted and extended position in use.

7. A machine as claimed in claim 6, for use in folding cartons of the type having front and back load supportive collar flaps hingedly connected to the front and back walls respectively, intermediate the top and bottom of said carton wherein said guide means having means to locate said fold backing member in an intermediate position in which said folding edge is located proximate said collar hinge during folding of said locking collar flaps along said collar hinge.

8. A machine as claimed in claim 7, wherein each fold backing member has a follower roller mounted thereon and said guide means comprises a guide track along which said follower roller travels as said carton conveyor is driven through a carton erecting station.

9. A machine as claimed in claim 6, further comprising a top closure mechanism mounted in a top closure station, said top closure mechanism comprising kicker blade means mounted for rotation above the top closure station, said kicker blade means engaging the trailing top closure flap to fold it from its open position to its closed position, a first plow blade extending above the top closure station for plowing the leading top closure flap from its open position to its closed position and front and back plow blades extending above the top closure station, downstream of the first plow to fold the front and back top closure flaps from their first position to their second position in which they overlie the side flaps.

10. A machine as claimed in claim 9, further comprising first tamping means mounted above the top closure station for movement toward and away from the closed top end of a carton located in the top closure station to depress the top closure flap to a sufficient extent to cause the comer hinges to apply a downwardly biasing load to the top closure flaps which retains the top closure flaps in a slight downwardly biased position, at each side of the loading opening.

11. A machine as claimed in claim 10, for use in folding cartons of the type havig front and back load supportive collar flaps hingedly connected to the front and back walls respectively, wherein said guide means serves to locate said fold backing member in an intermediate position in which said folding edge is located proximate said second hinge during folding of said locking collar flaps along said second hinge.

12. A machine as claimed in claim 11, wherein each fold backing member has a follower roller mounted thereon and said guide means comprises a guide track along which said follower roller travels as said carton conveyor is driven through a carton erecting station.

13. A machine as claimed in claim 10, further comprising a top closure mechanism mounted in a top closure station, said top closure mechanism comprising kicker blade means mounted for rotation above the top closure station, said kicker blade means engaging the trailing top closure flap to fold it from its open position to its closed position, a first plow blade extending above the top closure station for plowing the leading top closure flap from its open position to its closed position and front and back plow blades extending above the top closure station, downstream of the first plow to fold the front and back top closure flaps from their first position to their second position in which they overlie the side flaps.

14. A machine as claimed in claim 13, further comprising first tamping means mounted above the top closure station for movement toward and away from the closed top end of a carton located in the top closure station to depress the top closure flap to a sufficient extent to cause the comer hinges to apply a downwardly biasing load to the top closure flaps which retains the top closure flaps in a slight downwardly biased position, at each side of the loading opening.

15. A machine as claimed in claim 11, further comprising a tucking station in which the collar flaps are folded inwardly of the carton and tucking means in said tucking station comprising;

front and back tucking blades mounted to reciprocate to and fro between a retracted position disposed opposite and spaced outwardly from the front and back collar flaps and an extended position located inwardly of the front and back walls of a carton located in said tucking station to fold the front and back collar flaps inwardly along their hinge connection, said back-up guide means serving to locate said back-up means in a position to back-up the front and back walls of the carton immediately below the collar flap hinges.

16. A machine as claimed in claim 15, wherein said front and back tucking blades reciprocate one in a first plane which extends perpendicular to the side wall of the carton and the other in a second plane which is inclined downwardly toward the first plane, said one tucking blade having a leading end which extends in a plane substantially parallel to said second plane and said other tucking blade having a leading end which extends in a plane substantially parallel to said first plane such that when said tucking blades are both in their extended positions, the leading ends thereof will not intefere with one another.

17. A machine for erecting an end loading carton of the type having; front, back, leading and trailing panels hingedly connected to one another to form a sleeve within which a load storage compartment is formed, a top closure comprising front, back, leading and trailing top closure flaps hingedly connected to the front, back, leading and trailing side panels respectively, along top closure hinge lines, said top closure flaps being foldable about said top closure hinge lines between an open position in-line with the side walls to provide an open loading passage opening into the load storage compartment and a closed position in which they extend inwardly of the load storage compartment, front and back load supportive collar flaps hingedly connected to the front and back walls respectively intermediate the top and bottom of said carton, a carton support assembly comprising;

(a) a carton conveyor, (b) a carton receptacle mounted on the carton conveyor, said receptacle having a back wall and a pair of side walls arranged to form a U-shaped compartment with the open side thereof opening laterally from the carton conveyor, said receptacle having an open upper end, (c) stop means on the walls of the compartment for supporting the lower end of a carton located in said compartment in use, (d) a fold backing member slidably mounted in each receptacle and providing movable folding edge over which said top closure may be folded, said fold backing member being proportioned to slide within a carton located in said carton receptacle between a retracted position located below the load storage compartment and an extended position underlying said top closure hinge lines during folding of said top closure flaps in use, and (e) guide means for moving said fold backing member to and fro between said retracted and extended position in use wherein said guide means having means to locate said fold backing member in an intermediate position in which said folding edge is located proximate said collar hinge during folding of said locking collar flaps along said collar hinge.

18. A machine as claimed in claim 17, further comprising a tucking station in which the collar flaps are folded inwardly of the carton and tucking means in said tucking station comprising;

front and back tucking blades mounted to reciprocate to and fro between a retracted position disposed opposite and spaced outwardly from the front and back collar flaps and an extended position located inwardly of the front and back walls of a carton located in said tucking station to fold the front and back collar flaps inwardly along their hinge connection, said back-up guide means serving to locate said back-up means in a position to back-up the front and back walls of the carton immediately below the collar flap hinges.

19. A machine as claimed in claim 18, wherein said front and back tucking blades reciprocate one in a first plane which extends perpendicular to the side wall of the carton and the other in a second plane which is inclined downwardly toward the first plane, said one tucking blade having a leading end which extends in a plane substantially parallel to said second plane and said other tucking blade having a leading end which extends in a plane substantially parallel to said first plane such that when said tucking blades are both in their extended positions, the leading ends thereof will not intefere with one another.

20. A machine for erecting, loading and closing an end loading carton of the type having front, back, leading and trailing panels hingedly connected to one another to form a sleeve within which a load storage compartment is formed, a window opening formed in the front and back panels through which the load storage compartment may be viewed, front and back loading supporting collar flaps hingedly connected to the front and back walls respectively, along first transverse hinge lines, first corner hinge panels connecting the collar flaps to each side wall and serve to permit the collar flaps to move between a first position in-line with their associated front and back walls and a second position in which they are inclined inwardly of the container spaced to form support collars for a load item, and a top closure comprising front, back, leading and trailing top closure flaps hingedly connected to the front, back, leading and trailing walls respectively, along second transverse hinge lines, second corner hinge panels connecting adjacent ends of the front and side top closure flaps and adjacent ends of the back and side top closure flaps, said top closure flaps being foldable about said second hinge lines between an open position in-line with the side walls to provide an open loading passage opening into the load storage compartment and a closed position in which they extend inwardly and downwardly toward the load storage compartment, said machine comprising;

(a) a carton erecting and closing mechanism comprising; a carton conveyor, a plurality of carton support assemblies mounted on said carton conveyor, said carton conveyor being mounted for movement along an endless path which extends through; a dispenser station in which a knocked-down carton is removed from a storage magazine and deposited in the form of an open sleeve, in a carton support assembly, a top closure station in which the top closure flaps are folded along the second hinge lines from their open position to their closed position, a collar flap tucking station in which the collar flaps are folded inwardly, a loading station in which load items are inserted through the loading opening, a load tamping station in which the load items are tamped to permit the top closure flaps to assume a locking position with respect to the load item, a discharge station in which loaded cartons are discharged from the carton support assemblies, (b) said carton support assembly comprising;

a carton receptacle mounted on the carton conveyor, said receptacle having a back wall and a pair of side walls arranged to form a U-shaped compartment with the open side thereof opening laterally from the carton conveyor, said receptacle having an open upper end, stop means on the walls of the compartment for supporting the lower end of a carton located in said compartment in use, a fold backing member slidably mounted in each receptacle, said fold backing member having folding edge over which various flaps and panels may be folded along their fold lines, first guide means extending through each station and communicating with the fold backing member for controlling the position of each fold backing member with respect to its associated receptacle, a retaining rail extending from the output end of the transfer station to the input end of the discharge station in a position disposed opposite the open side of the U-shaped receptacle to retain a carton therein, (c) a top closure mechanism in said top closure station comprising;

kicker blade means mounted for rotation above the top closure station, said kicker blade means engaging the trailing top closure flap to fold it from its open position to its closed position, a first plow blade extending above the top closure station for plowing the leading top closure flap from its open position to its closed position and front and back plow blades extending above the top closure station, downstream of the first plow to fold the front and back top closure flaps from their first position to their second position in which they overlie the side flaps, first tamping means mounted above the top closure station for movement toward and away from the closed top end of a carton located in the top closure station to depress the top closure flap to a sufficient extent to cause the comer hinges to apply a downwardly biasing load to the top closure flaps which retains the top closure flaps in a slight downwardly biased position, at each side of the loading opening, said first guide means being arranged to cause the fold backing member to be elevated to locate the folding edge thereof inwardly of the first transverse hinge lines to provide a backing over which the collar flaps may be folded, (d) collar flap tucking means in said tucking station comprising;

front and back tucking blades mounted to reciprocate to and fro between a retracted position disposed opposite and spaced outwardly from the front and back collar flaps and an extended position located inwardly of the front and back walls of a carton located in said tucking station to fold the front and back collar flaps inwardly along their hinge connection, said back-up guide means serving to locate said back-up means in a position to back-up the front and back walls of the carton immediately below the collar flap hinges, (e) a load transporting mechanism comprising;

a load transporting conveyor, a plurality of load transporting heads mounted on said conveyor, drive means for driving the load transport conveyor to locate successive load transporting heads in and to transport them through a receiving station in which load items are located on each head and said loading station in which load items are transferred from the transporting heads to the load storage compartment of a carton, said load transporting heads each comprising, a backing member, a pair of load support gates each having an upper end and a lower end, said gates being pivotally mounted on said backing member for movement between a first position in which they co-operated with one another to form an upwardly open load support pocket therebetween, and a second position in which the lower ends of the gates are spaced from one another to a sufficient extent to form a discharge passage therebetween through which the load may be discharged in use, a lever arm mounted on each support gate outwardly from the load support pocket, said lever arms projecting toward one another, one on either side of an actuator path which extends longitudinally therebetween, biasing means resiliently biasing said support gates to said first position, (f) load transfer means in said loading station comprising;

a stationary support, a carriage slidably mounted on the stationary support for movement between a raised position and a lowered position, first actuator means for moving said carriage to and fro between said raised and lowered position, second actuator means mounted on the carriage, pickup means mounted on said second actuator means for movement with and relative to the carriage toward and away from a load located in a pocket of a load carrier aligned therewith in the load transfer station, said pickup means being operable when located in close proximity to the load to raise the load a short distance to unseat it with respect to said pocket, gate opening means mounted on said second actuator means for movement between an extended position and a retracted position with respect to said receptacle to engage said lever means as it moves toward said extended position to cause the gates to pivot from their first position to their second position, said second actuator means displacing the pickup means to a sufficient extent after unseating the load to drive the load downwardly through the discharge passage formed between the lower ends of the gates and through said loading passage formed in the top closure of a carton located in said loading station, and second tamping means mounted in said load tamping station for movement between a raised position located above a load in a load storage compartment of a carton and second position engaging said load and depressing it into the load storage compartment to a sufficient extent to release the top closure flaps to allow them to assume a position in which they narrow the loading passage to prevent the removal of the load therethrough, and discharge means in the discharge station for discharging loaded cartons from said carton conveyor.

* * * * *